United States Patent [19]

Sampa et al.

[11] Patent Number: 4,984,632

[45] Date of Patent: Jan. 15, 1991

[54] HYDRAULIC RELEASE JOINT FOR TUBING SYSTEMS

[75] Inventors: Augdon Sampa, Stafford; Bart Thomeer, Houston, both of Tex.

[73] Assignee: Dowell Schlumberger Incorporated, Tulsa, Okla.

[21] Appl. No.: 328,667

[22] Filed: Mar. 27, 1989

[51] Int. Cl.[5] ..... E21B 23/00

[52] U.S. Cl. ..... 166/237; 166/242

[58] Field of Search ..... 166/242, 243, 77.5, 166/85, 123, 181, 212, 237; 285/18, 83, 306

[56] References Cited

U.S. PATENT DOCUMENTS 3,215,204 11/1965 Sims ..... 285/18

4,289,202 9/1981 Henderson ..... 166/212

4,722,390 2/1988 Smith, Jr. ..... 166/181

4,840,229 6/1989 Proctor et al. ..... 166/237

*Primary Examiner*—Ramon S. Britts

*Assistant Examiner*—Terry Lee Melius

*Attorney, Agent, or Firm*—Stephen A. Littlefield

[57] ABSTRACT

A tubing release coupling which does not require rotation to effect release incorporates a collet which is retained within a groove by a collet retainer located on an axially movable piston. The piston is retained in place thereby locking the collet by a detent cantilever spring. Pressure differential between the tubing the annulus forces axial movement of the piston against the spring force of the cantilever spring effecting release of the collet. The spring force of the detent cantilever spring may be adjusted by positioning spring adjusters at a variable distance.

3 Claims, 2 Drawing Sheets

HYDRAULIC RELEASE JOINT FOR TUBING SYSTEMS

This invention relates to the art of well operations and, more particularly, to a release joint for disengaging a tubing coupling.

BACKGROUND OF THE INVENTION

In well operations, with the insertion and retrieval of tubular materials from a well, it is not uncommon to have a tool located at the lower end of a tubing string become stuck in the well. Rather than leave the entire tubing string in the wellbore, it is occasionally desirable to break the connection between the tool and the remaining portions of the tubing string so that with retrieval of the tubing string, only a small portion of the well is blocked by the stuck tool.

Many tool release mechanisms are used for this purpose. The most common joints between tubing and the well tool involve a threaded interconnection or a common J-latch arrangement. The release of these joints, however, necessitates the rotation of the tubing string in order to effect release of the coupling. In coiled tubing operations, it is virtually impossible to effect rotational movement of the tubing string. With other tubing string systems, it is occasionally also undesirable to employ rotational movement of the string even though such rotation may be possible.

Coupling means which do not require rotation of the tubing string such as compression or bellville springs do not provide sufficient holding force for maintaining the coupling interconnection at all times when it is desired. Release of such couplings resulting from minor impacts can lead to expensive fishing/retrieval operations which might not otherwise be required. Such couplings also require a large amount of annular space for the release mechanism. Thus, with restricted overall diameter of the tool or coupling, very little flow passage remains within the coupling for any given release pressure. In order to accommodate higher release pressures, correspondingly larger annular space must be taken up by the release mechanism. An additional problem with the release of such couplings is the consistency of the release pressure required since overcoming seal and tubing frictional pressure constitutes a large part of the force required to effect release.

SUMMARY OF THE INVENTION

The present invention provides a tubing release joint which does not require rotational movement, has a consistent, adjustable holding force for maintaining the coupling interconnection, such holding force being much greater than that available with either compression or bellville tubing coupling release systems in the same or less annular space..

In accordance with the invention, a tubing coupling comprises:

(a) a first tubular body having an outer surface and a radially outwardly extending collet;

(b) a second tubular body having an inner bore and an outer surface including:

(1) annular grove means for receiving the collet of the first tubular body;

(2) an axially movable release piston having an outer surface and including a collet retainer, the piston being located within the inner bore of the second tubular body;

(3) a detent retaining groove located on either the outer surface of the piston or the inner bore of the second tubular body adjacent the piston and, (4) a cantilever spring having a detent which is retained within the detent retaining groove, the cantilever spring engaging the other of either the outer surface of the axially movable release piston or the inner bore of the second tubular body whereby differential pressure between the first and second tubular bodies and the outer surfaces of the first and second tubular bodies causes the release piston to move axially against the cantilever spring thereby releasing its detent from the detent retaining groove permitting release of the collet retainer from the collet so that an axial tension force can separate the first and second tubular Further in accordance with the invention, engagement points of the cantilever spring against either the release piston or the inner bore of the second tubular body are adjustable to effect an adjustable pressure release of the coupling.

It is therefore an object of this invention to provide a non-rotational coupling release.

It is a further object of this invention to provide a coupling release which has a greater holding force than other non-rotational types of tubing couplings.

It is yet another object of this invention to provide a hydraulic release coupling in which the release pressure can be adjusted over a wide range.

BRIEF DESCRIPTION OF THE DRAWINGS

The invention will now be described in greater detail in conjunction with the accompanying drawings illustrating a preferred embodiment of the invention and forming a part of this specification in which.

DETAILED DESCRIPTION OF THE PREFERRED EMBODIMENTS AND THE DRAWINGS

Figure 1:
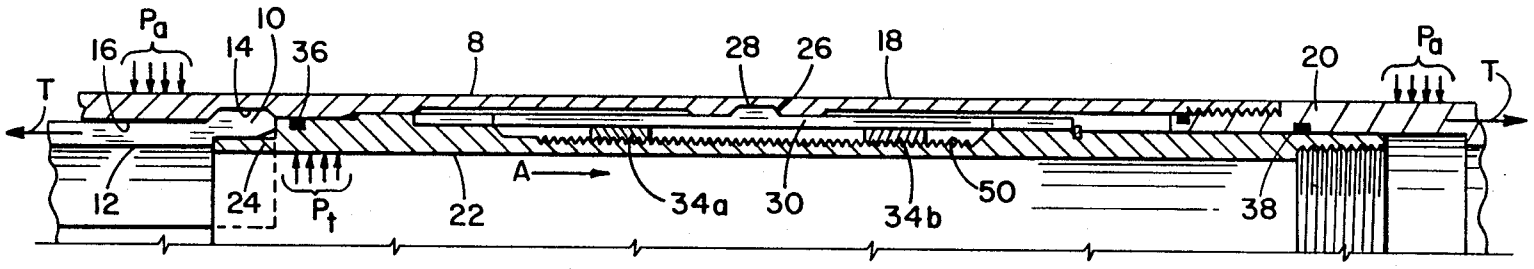
FIG. 1 is a partial cross-sectional view of a coupling in accordance with the present invention.

Referring now to drawings wherein the showings are for the purpose of illustrating a preferred embodiment of the invention only and not for the purpose of limiting with the invention. A radially extending collet 10 at one of a first tubular body 12, the collet 10 being retained within an annular groove 14 located on the inner bore 16 of a second tubular body 18. The second tubular body 18 is connected such as through a threaded coupling to a well tool 20. A tubular, axially movable piston 22 is located within the inner bore 16 of the second tubular body 18. The axially movable piston 22 includes an annular collet retainer 24 which extends onto the inner surface of the collet 10 of the first tubular body 12 thereby holding the collet 10 securely within the annular groove 14 of the second tubular body 18. When tensional force T is applied to the assembly, the collet retainer 24 maintains the collet 10 in a locked relationship between the first and second tubular bodies, 12 and 18, respectively.

Figure 2:
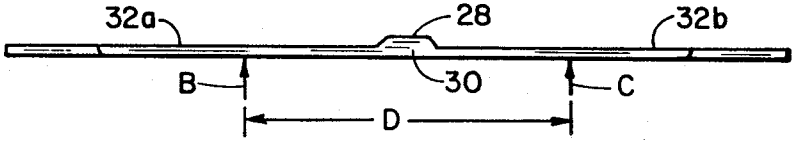
FIG. 2 is a side elevational view of one form of cantilever release spring in accordance with the invention.

In accordance with the invention, the inner bore 16 of the second tubular body 18 also includes a detent retaining groove 26. A detent 28 (FIG. 2) of a detent cantilever spring 30 is retained within the detent retaining groove 26. The detent cantilever spring 30 also includes a pair of axially outwardly extending leg portions 32*a*, 32*b*, which engage the outer surface of the tubular, axially movable piston 22.

In accordance with a preferred embodiment of the invention, the effective length of the axially outwardly extending leg portions 32*a*, 32*b* may be adjusted by positioning a pair of spring adjusters 34*a*, 34*b*, the adjusters 34*a*, 34*b* effectively adjusting the spring rate of the detent cantilever spring 30.

Figure 3:
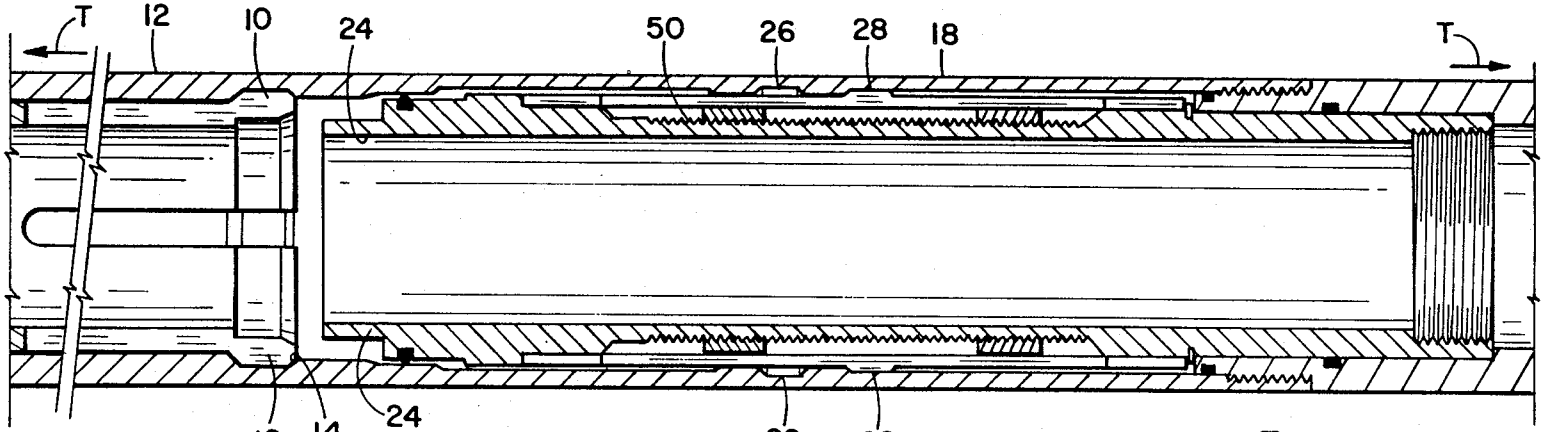
FIG. 3 is similar to FIG. 1 but illustrating the release position of the coupling.

In operation of the tool and release coupling 8, tubing pressure $P_t$ is isolated from annulus pressure $P_a$ by seals 36, 38 along the piston 22. If release of the coupling 8 is desired, the pressure differential between the tubing pressure $P_t$ and the annulus pressure $P_a$ is increased to a point at which the pressure differential tending to cause axial movement of the axially movable piston 22 in the direction of the arrow A overcomes the spring force in the detent cantilever spring 30 to move the detent 28 out of the detent retaining groove 26 thereby permitting axial movement of the piston 22 in the direction of the arrow A. FIG. 3 illustrates the released condition wherein the collet retainer 24 is no longer in engagement with the collet 10 of the first tubular body 12. Similarly, the detent 28 is no longer retained within the detent retaining groove 26. With the application of tensional force T to the first and second tubular bodies 12, 18, the collet 10 releases from the annular groove 14 thereby disconnecting the coupling between the first tubular body 12 and the second tubular body 18.

Although the relationship of the cantilever spring 30, its detent 28 and the axially outwardly extending leg portions 32*a*, 32*b*, have been described with respect to an assembly wherein the detent retaining groove 26 is located on the inner bore 16 of the second tubular body 18 and the outwardly extending leg portions 32*a*, 32*b* engage the axially movable piston 22, it will be apparent to those skilled in the art that an inverse assembly may be possible with the cantilever spring oriented so that its detent is retained in a detent retaining groove located in the axially movable piston and that the leg portions of the cantilever spring engage the inner bore of the second tubular body.

Figure 4:
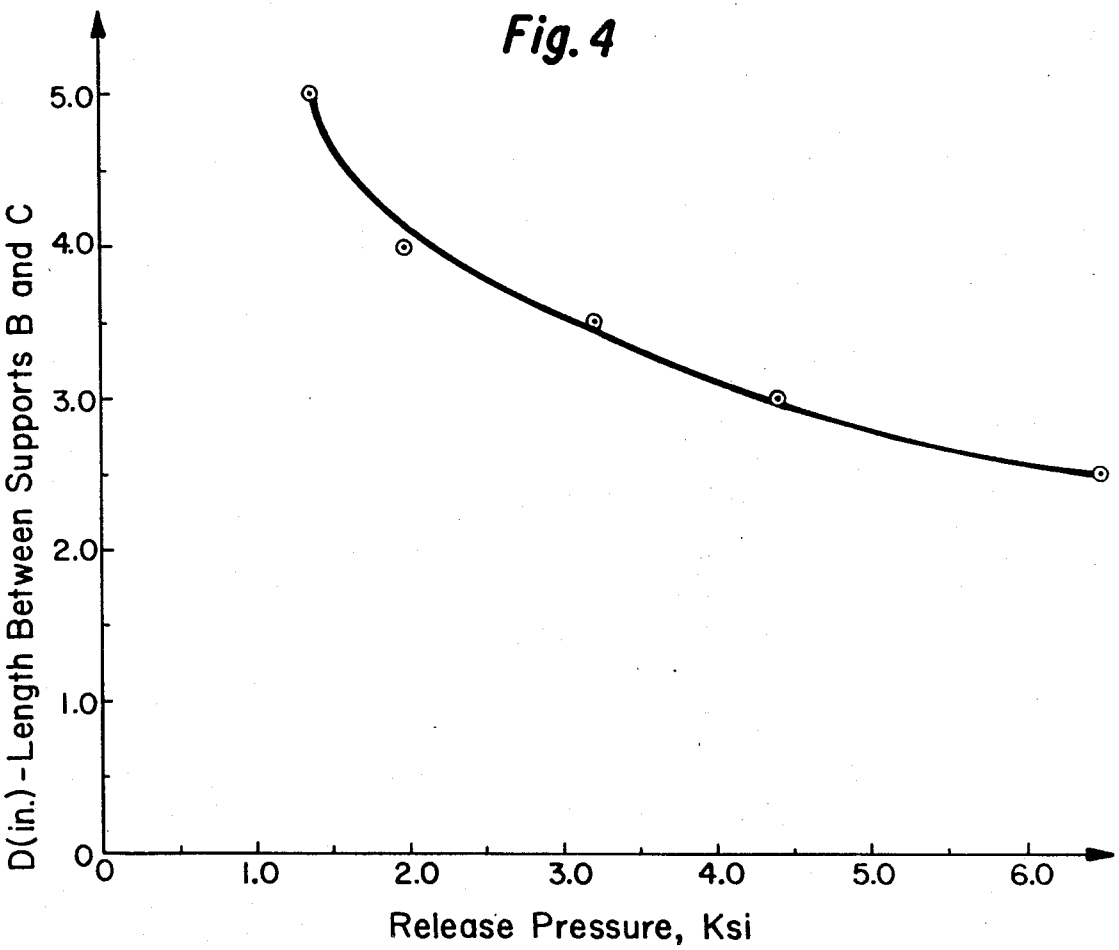
FIG. 4 is a graph illustrating the adjustability of the release pressure based on the placement of spring adjusters with respect to the cantilever spring in accordance with a preferred embodiment of the invention.

FIG. 4 is a graphic representation of the variation in spring rate and, thereby, the release pressure differential required to effect axial movement of the axially movable piston based on the positioning of spring adjusters 34*a*, 34*b*. It can be clearly seen that by increasing the distance D between the positions B and C (FIG. 2) of the spring adjusters 34*a*, 34*b*, the pressure differential required for release of the coupling decreases and, conversely, the shorter the distance D, the greater the release pressure differential required. It can thus be seen that the release pressure can be varied over a wide range so that undesired release of the coupling is avoided. In the preferred embodiment of the invention shown in FIGS. 1 and 3, the spring adjusters 34*a*, 34*b* comprise threaded split rings which engage the threads 50 of the axially movable piston member 22. It can be clearly seen that substantially infinite adjustability of the spring rate can be effected by the threaded movement of the spring adjusters 34*a*, 34*b* along with length of the outwardly extending leg portions 32*a*, 32*b* of the detent cantilever spring 30.

It will be understood while the detent cantilever spring 30 has been shown in conjunction with the use spring adjusters 34*a*, 34*b*, such adjusters are not necessary and a cantilever spring 30 which would not use such adjusters would have a single, non-adjustable spring rate. However, the spring rate of a non-adjustable cantilever spring may be altered by employing springs of different metallurgical composition which would have different spring rate.

While the invention has been described in the more limited aspects of a preferred embodiment thereof, other embodiments have been suggested and still others will occur to those skilled in the art upon a reading and understanding of the foregoing specification. It is intended that all such embodiments be included within the scope of this invention as limited only by the appended claims.

Having thus described our invention, we claim:

1. A tubing coupling comprising:

(a) a first tubular body having an outer surface and a radially outwardly extending collet, and (b) a second tubular body having an inner bore and an outer surface and further including:

(1) annular grove means for receiving said collet of said first tubular body;

(2) an axially movable piston having an outer surface and including a collet retainer, said piston located within said inner bore of said second tubular body;

(3) a detent retaining groove located on one of said outer surface of said piston and said inner bore of said second tubular body adjacent said piston, and (4) a cantilever spring having a detent which is retained within said detent retaining groove, said cantilever spring having leg portions and spring adjusters located between said leg portions of said cantilever spring and the other of said outer surface of said piston and said inner bore of said second tubular body, whereby differential pressure between internal pressure within said first and second tubular bodies and pressure acting on said outer surfaces of said first and second tubular bodies causes said piston to move axially against a force of said cantilever spring thereby releasing its detent from said detent retaining groove permitting release of said collet retainer from said collet so that an axial tension force can separate said first and second tubular bodies.

2. A coupling as set forth in claim 1 wherein said detent retaining groove is located on said inner bore of said second tubular body adjacent said piston, said axially movable piston includes helical threads and said spring adjusters comprise threaded split rings.

3. The coupling as set forth in claim 1 wherein said detent retaining groove is located on said outer surface of said piston, said inner bore of said second tubular body includes helical threads and said spring adjusters comprise threaded split rings.

* * * * *